US009556635B2

(12) United States Patent
Lyublinski et al.

(10) Patent No.: US 9,556,635 B2
(45) Date of Patent: Jan. 31, 2017

(54) STORAGE TANK BOTTOM CORROSION PROTECTION SYSTEM

(71) Applicant: NORTHERN TECHNOLOGIES INTERNATIONAL CORPORATION, Beachwood, OH (US)

(72) Inventors: Efim Ya Lyublinski, Solon, OH (US); Gautam Ramdas, Beachwood, OH (US); Yefim Vaks, South Euclid, OH (US); Terry Alan Natale, Hudson, OH (US); Monique Humbert Posner, Shaker Heights, OH (US); Kelly M. Baker, Spring, TX (US); Alexander Roytman, Solon, OH (US)

(73) Assignee: Northern Technologies International Corporation, Beachwood, OH (US)

( * ) Notice: Subject to any disclaimer, the term of this patent is extended or adjusted under 35 U.S.C. 154(b) by 311 days.

(21) Appl. No.: 14/557,937

(22) Filed: Dec. 2, 2014

(65) Prior Publication Data

US 2015/0307256 A1 Oct. 29, 2015

Related U.S. Application Data

(60) Provisional application No. 61/985,099, filed on Apr. 28, 2014.

(51) Int. Cl.
*C23F 11/02* (2006.01)
*C23F 11/18* (2006.01)
(Continued)

(52) U.S. Cl.
CPC ..... *E04H 7/00* (2013.01); *C23F 11/02* (2013.01); *C23F 11/187* (2013.01); *E04H 7/06* (2013.01)

(58) Field of Classification Search
CPC ..... C23F 11/02; C23F 11/187
See application file for complete search history.

(56) References Cited

U.S. PATENT DOCUMENTS

| | | | |
|---|---|---|---|
| 5,305,631 | A | 4/1994 | Whited et al. |
| 6,339,951 | B1 | 1/2002 | Kashmiri et al. |
| 7,794,583 | B2 | 9/2010 | Lyublinski |

OTHER PUBLICATIONS

Miksic, Storage Tank Protection Using Volatile Corrosion Inhibitors, Materials Performance, 34-37, Jun. 2006.

(Continued)

*Primary Examiner* — Sean E Conley
*Assistant Examiner* — Donald Spamer
(74) *Attorney, Agent, or Firm* — Hudak, Shunk & Farine Co. LPA

(57) ABSTRACT

A system for protecting storage tank soil side bottoms against corrosion includes a pipe system comprising non-perforated inlet pipes and perforated pipes connected thereto. A sleeve container having solid VCI compounds therein is inserted into the perforated pipes. The sleeves are permeable to vapors emitted by the solid VCI compounds and flow through the pipe to a perforation where they are admitted into an area beneath a storage tank so that they can contact the tank bottom (soil side) and protect the same from corrosion. Alternatively, solid SCI compounds can be used in combination with VCI compounds. The corrosion protection system is designed to be used with aboveground storage tanks. This includes, but is not limited to, single bottom tanks: newly installed or existing tanks undergoing bottom replacement or installation of double bottoms. These tanks are located on substrates such as the compacted soil/sand or hard substrates such as concrete, bitumen mixtures and asphalt where channels can be cut into the substrate for installation of the pipe system.

20 Claims, 2 Drawing Sheets

(51) Int. Cl.
*E04H 7/00* (2006.01)
*E04H 7/06* (2006.01)

(56) References Cited

OTHER PUBLICATIONS

Gandhi, Storage Tank Bottom Protection Using Volatile Corrosion Inhibitors, Cortec Corp., Supplement to Materials Performance, Jan. 2001.

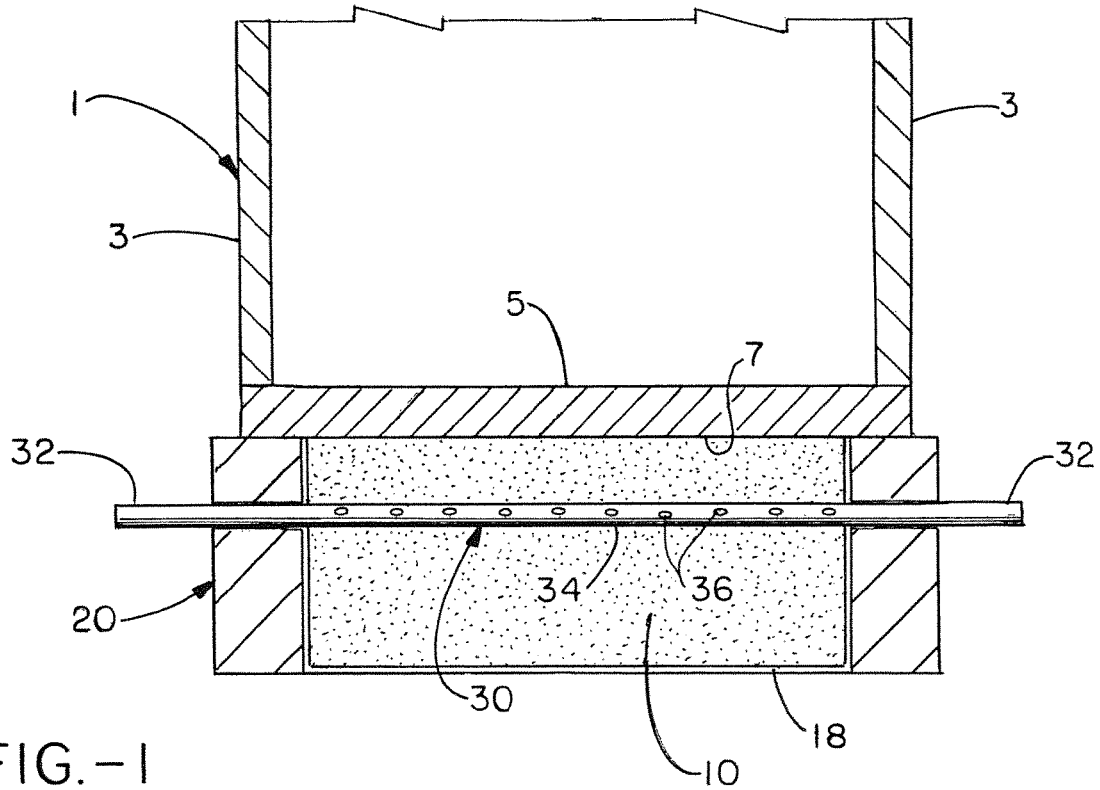
FIG.-1
FIG.-3
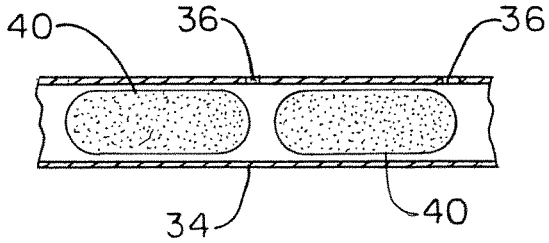
FIG.-5
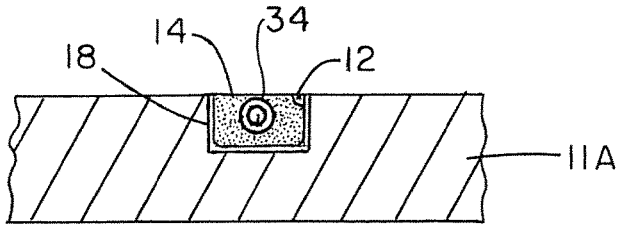

STORAGE TANK BOTTOM CORROSION PROTECTION SYSTEM

CROSS REFERENCE

This application is a conversion application of U.S. patent application No. 61/985,099, filed Apr. 28, 2014, for "A Storage Tank Corrosion Inhibitor System", which is hereby fully incorporated by reference.

FIELD OF THE INVENTION

The present invention relates to a system for the corrosion protection of storage tank soil side bottoms generally located on a dry substrate. The system comprises pipes that are perforated and designed to receive a sleeve that contains one or more solid volatile corrosion inhibitors (VCI) compounds therein. In an alternative embodiment, mixtures of solid VCI and SCI (soluble corrosion inhibitors) can be used. The sleeve is porous, can breathe and therefore upon vaporization of the solid VCI compound the vapor is emitted therefrom and subsequently emitted from the perforated pipe into a tank substrate area. An advantage to the pipe system is that after release of the VCI vapors and generally upon depletion of the solid VCI compounds, the sleeves can be removed and replenished or the pipes restocked with new solid VCI sleeves. The present system thus eliminates the need for any slurry such as VCI slurries or SCI slurries and also eliminates the need for blowing any VCI powders into the piping system since uniform distribution of the inhibitor powders throughout the entire piping system is difficult to obtain.

BACKGROUND OF THE INVENTION

In aboveground storage tanks, corrosion of soil side bottoms and double bottoms is unpredictable and can reduce the thickness of the tank bottom up to about 5 mm/year. A typical corrosion protection method, i.e., cathodic protection system (CPS), in most cases is not effective by itself due to inherent dry soil conditions at least during some part of a year as well as issues with tank design and geometry that creates holidays in the cathodic protection. The use of SCI, as with CPS, is only viable in fully saturated sand or soil and it is generally difficult to obtain such saturated conditions. Protective coatings cannot be applied to existing soil side tank bottoms. Any protective coatings applied to the soil side tank bottoms will be destroyed in the weld zones and may actually accelerate corrosion in those areas.

In summary, soil side corrosion of aboveground storage tanks either with a single bottom or a double bottom is a major worldwide problem. Such tanks face unpredictable application and environmental conditions that often cause the bottoms to leak. Moreover, dangerous operating conditions occur when the leaking product is volatile or flammable. Another disadvantage is that repair of tank bottoms generally requires down time.

SUMMARY OF THE INVENTION

An aspect of the present invention is to provide corrosion protection for the soil side bottom of installed storage tanks. This includes, but is not limited to new tanks, e.g. single or double bottom tanks, or existing single or double bottom tanks undergoing bottom replacement or installation of double bottoms. These tanks are located on substrates such as compacted soil/sand or hard substrates such as concrete, bitumen mixtures and asphalt where trenches or channels can be cut into the substrate for installation of the pipe system. Another aspect of the present invention is a pipe system comprising a set of generally parallel perforated or porous pipes. A still further aspect of the present invention is the use of porous or vapor permeable sleeve containers that can have one or more solid VCI compounds therein so that upon vaporization of the VCI compound, the vapor can pass along the perforated pipes and be emitted from the perforations so they can penetrate into the tank substrate area and contact the soil side bottom of the tank to provide protection thereto. That is, the VCI volatilizes and creates in the vapor space a gas with the concentration related to its vapor pressure. Part of the VCI adsorbs on the metal surface or absorbs in the condensed water layer, and provides corrosion protection due to different mechanisms, e.g. by creating insulating or passivation layer or due to decreasing corrosion aggressiveness of the environment, for example due to increasing of the pH.

An advantage to the pipe system is that after release of the VCI vapors and generally upon depletion of the solid VCI compounds, the sleeves can be removed and the pipes restocked with either refilled sleeves or new solid VCI sleeves.

A storage tank corrosion protection system comprises: a pipe system comprising one or more perforated pipes located beneath said storage tank; at least one sleeve container having at least one solid volatile corrosion inhibitor (VCI) compound therein, said at least one sleeve capable of being located within at least a portion of said perforated pipes, said sleeve portion initially being free of a liquid, and said perforated pipe being free of a blown in VCI powder; optionally at least one solid SCI compound mixed with said solid VCI compound located in said sleeve container; said sleeve being permeable to vapor emitted from said at least one solid VCI compound but not permeable to said solid VCI compound, said vapor capable of being emitted from said piping system through said perforations of said perforated pipe.

A process system for providing corrosion protection to a storage tank soil side bottom, comprising: a pipe system comprising one or more perforated pipes located under said storage tank bottom having a tank substrate area there below; one or more sleeve containers having at least one solid VCI compound therein, said sleeve being permeable to vapor emitted from said at least one solid VCI compound but not permeable to said solid VCI compound, said sleeve container being initially free of a liquid; optionally at least one solid SCI compound mixed with said solid VCI compound located in said sleeve container; inserting said one or more sleeve containers into said pipe system, said sleeve adapted to release said VCI vapor into said perforated pipe; and subsequently emitting said VCI vapor from said perforated pipe into said tank substrate area.

BRIEF DESCRIPTION OF THE DRAWINGS

FIG. 1 is a cross-section side elevation view of a storage tank located upon a substrate containing a pipe system of the present invention;

FIG. 3 is a cross-section side elevation view of a portion of a perforated pipe having a solid VCI filled sleeve therein;

FIG. 5 is a cross-section side elevation view of a tank substrate having a channel therein.

DETAILED DESCRIPTION OF THE INVENTION

Storage tanks have a bottom or double bottom base plate that inherently are contained or located upon a substrate. Substrates typically encompass soil optionally containing small stones therein and/or a layer of sand thereon, or hard surface materials such as concrete, bitumen mixtures, or asphalt. The external side of the tank bottom plate surface that is situated on or contacts the substrate typically is referred to as the tank soil side bottom. Such tank soil side bottoms are subject to corrosion during the course of time. The area below the tank soil side bottom is generally defined as the "tank substrate area".

An important aspect of the present invention is the utilization of a pipe system that includes one or more perforated pipes. Contained within perforated pipes is a sleeve container that has one or more volatile corrosion inhibitors (VCI) that are in a solid state but upon vaporization permeate the sleeve and flow to and through the pipe perforations into and/or along the tank substrate area. The pipe system of the present invention is preferably suited for generally dry substrates but can also be used on substrates that contain water or liquid therein since then the VCI would be emitted from the liquid.

Figure 2:
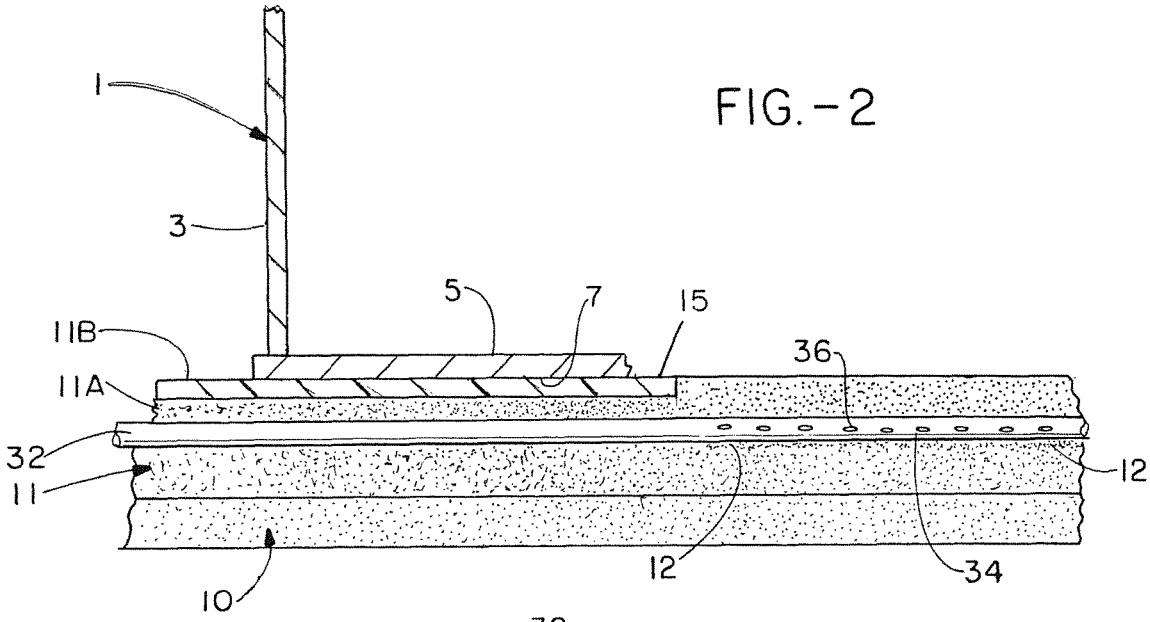
FIG. 2 is a cross-section side elevation view of another embodiment of a storage tank located upon a hard substrate such as concrete or asphalt and containing a pipe system of the present invention.

As shown in FIGS. 1 and 2, a typical storage tank 1 contains sidewalls 3 and bottom 5. The underside of bottom surface 5 is generally referred to as the tank soil side bottom 7 that is in contact with substrate 10, 11, 11A or 11B. Ring wall 20 generally forms a support for vertical tank sides 3 and is typically made of concrete or other hard material.

Figure 4:
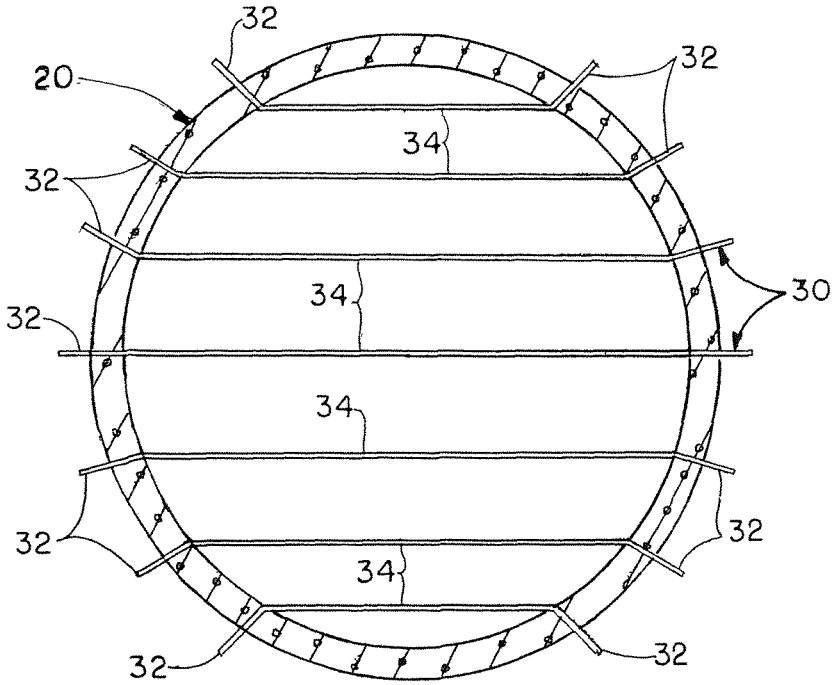
FIG. 4 is a top plan view of a pipe grid system of the present invention.

According to the concepts of the present invention, pipe system 30 exists within substrate 10 and is more clearly shown in FIGS. 1 and 4. Substrate 10 is generally natural such as soil, sand, clay, etc. Each perforated pipe 34 containing perforations 36 therein is attached to non-perforated pipes 32 on each end where the pipes pass through ring wall 20. While the pipes can be any spacial relationship, they are generally substantially parallel or parallel to one another generally less than about 10 degrees or desirabley less than about 5 degrees sloped away or towards an adjacent pipe in order to be uniformly distributed under the tank bottom. FIG. 4 is a top view of the parallel pipes in the tank base that extend through ring wall 20. Perforated pipes 34 can be made out of generally any noncorrosive material with plastics being preferred such as polyethylene, polypropylene, polyvinylchloride, polychloroprene, polyamide, various rubbers derived from butadiene, as well as styrene-butadiene copolymers, polyurethanes, acrylics and acrylic copolymers such as acrylonitrile-butadiene-styrene (ABS), phenolics, aminoplastics such as urea or melamine-formaldehydes, polyesters, and the like. The diameter of the perforated pipe can vary and generally is between about 0.5 cm to about 10 cm and preferably is between about 2 cm to about 5 cm.

The distance between adjacent pipes can vary greatly such as from about 1 to about 12 feet, and desirably from about 3 or about 5 feet to about 9 or about 10 feet, and preferably approximately 7 feet apart. Perforated pipes 34 extend across the length of the tank bottom with non-perforated pipes 32 extending through channels in the ring wall or base fill. Preferably, the non-perforated pipes are in line with perforated pipes 34 and thus there is no offset angle. Otherwise, when a non-perforated pipe is offset with respect to the perforated pipe, the offset angle is slight, such as about 1 or 5 degrees to about 40 or about 50 degrees, or desirably from about 1 or 5 degrees to about 20 or 30 degrees. This is to facilitate easy insertion of sleeve containers 40. That is, elbows, "T's", sharp bends and acute angles are not used since sleeve containers can readily jam therein. The present invention is thus free of such pipeline end constrictions.

For a tank with a ring wall, channels are cut through the ring wall. Typically a hole is bored through the ring wall and the liner. An unperforated section of the pipe is inserted through said bored hole and extends generally from about a few inches to about 1 or 2 feet and are sealed in place. The perforated pipes are attached to the "inner" end of the unperforated pipe and a cap is applied to the "outer" end. For a tank on a hard pad, a length of solid rod is driven approximately parallel to the tank bottom to form channel 12 till it emerges from under the tank. The solid pipe is then removed. A section of non-perforated pipe 32 is installed in the ring wall area and sealed into place with the perforated pipes being attached to the "inner" end of the unperforated pipe with a cap being applied to the "outer" end.

The perforated pipes can be curvilinear or desirably, generally straight with straight pipes being highly preferred. By "curvilinear" it is meant that the pipe curvature is such that the inserted sleeves will not jam therein. That is, it has a radius of curvature of at least about 0.3 meter or desirably at least about 0.6 meter or at least about 1 meter. Curvilinear pipes are also used to accommodate obstructions in the tank bottom.

As shown in FIG. 1, a preferred embodiment of the present invention relates to utilization of a liner 18 that is impermeable with regard to VCI and SCI chemicals. The purpose of the liner is to keep the VCI and SCI compounds located beneath the bottom portion of storage tank 1 as well as within ring wall 20 and within an area below pipe system 30 so that such compounds do not escape, leach out, etc. from beneath soil side bottom 7 of the tank. The liner can be made of various polymers or other noncorrosive materials. Examples of suitable polymers include PVC, polyolefins, polyurethanes, geomembranes, and the like. Examples of noncorrosive materials include various nonpolymeric materials such as bitumen or similar, clay liners, geosynthetic clay liners, and the like.

FIG. 2 relates to a cross-section side elevation view of a storage tank located on an artificial substrate 11 that can be a hard substrate 11B such as concrete or asphalt. Substrate 11B can be located on another substrate 11A that can be a hard, or a porous substrate, or a fill substrate such as sand or gravel. The artificial substrates can be located on top of each other. All such substrates are located on natural substrate 10, for example soil. Storage tank 1 has side wall 3 and bottom wall 5 with a hard substrate 11B such as asphalt being located under the tank. VCI released through perforations 36 of perforated pipe 34 generally will not penetrate hard substrate 11B but will propagate through substrate 11A that is desirably porous and then contact soil-side tank bottom 7 and form a protective coating thereon. Alternatively, as when substrate 11A may be hard or porous, or filled substrate, channels 12 are ground into substrate 11A to a depth to accommodate perforated pipe 34, see FIG. 5, that is located under tank bottom 5 and is connected at the outer end thereof to non-perforated pipe 32. The channel depth can vary as from 2 to about 6 or 8 inches with approximately 4 inches being desired. Liner 18 is applied to the bottom of the channel to reduce inhibitor losses into the substrate. Typical liner materials are as set forth above and can be bitumen or similar, PE film or geomembrane. Channel or trough 12 is then filled with a porous material such as sand 14. Naturally the channels are dug in generally straight lines that are parallel to one another as shown in FIG. 4. Thus, upon insertion of sleeves 40 into perforated pipe 34, the VCI content in the sleeve will volatilize and rise upward through sand 14 and contact the bottom of the tank to protect the same against corrosion.

An important aspect of the present invention is the utilization of sleeve containers 40 that have one or more solid VCI compounds therein. The utilization of sleeves is also very beneficial with respect to the ease of replenishment of the solid VCI compounds. The use of dry solid compounds is also important since VCI slurries or SCI slurries are generally not specified unless there is a continuous liner under the tank. In other words, a dry system and not an aqueous slurry is utilized wherein the perforated pipes are free of liquids such as water or solvents meaning that the total amount of liquid within the one or more sleeve containers 40 is generally about 10% or about 5% by weight or less, desirably about 3% by weight or less, and preferably about 1% by weight or less and very preferably nil, that is no amount of liquid exists, based upon the total weight of the one or more solid VCI compounds contained within the one or more sleeves.

Similarly, the utilization of blown in VCI powders is avoided since it is difficult to blow in sufficient or adequate amounts of VCI powder uniformly across the entire lengths of the perforated pipes. Also, since piping systems can have sharp bends, T-intersections, and the like, it is very difficult to supply adequate amounts of blown in VCI compounds thereto. Thus, the perforated piping system of the present invention is free of blown in VCI material meaning that the total amount thereof is generally less than 10% by weight, desirably less than about 5% by weight, or about 3% by weight, preferably at less than about 1% by weight and more preferably nil, based upon the total weight of the one or more solid VCI compounds contained in the one or more sleeve containers.

Sleeves 40 are made out of vapor permeable materials such as polymers, which can include both biodegradable and non-biodegradable materials but with non-biodegradable materials being highly preferred as in the form of fabrics. Natural polymers can be utilized such as cotton, hemp or wool. The fabrics can be woven or nonwoven, with spun bond fabrics being preferred. Suitable fabric polymers include various polyolefins such as polyethylene including Tyvek® and polypropylene, various polyesters, and various nylons. The sleeve material should have an air permeability of between about 1 to about 1,000 cubic feet per minute per square foot (cfm/ft$^2$), with the preferred range of about 50 or about 100 to about 300 or about 500. The average pore size for the sleeve material should be in the range of about 1 to about 500 microns with a preferred range of about 10 or about 20 to about 30 or about 50 microns.

The average diameter of the sleeve container can greatly vary as from about 5% or about 50% to about 90% or about 95% and desirably from about 70% to about 85% of the diameter of perforated pipes 34. The length thereof can generally vary from about 0.5 to about 50 meters and desirably from about 1 to about 2 meters. The key aspect with respect to both size and length is that the sleeve containers can be readily inserted into the pipes 34 as by pushing or pulling and as shown in FIG. 3 leave an upper space for the VCI vapors to migrate or travel to various perforations 36 whereby they are subsequently emitted from the pipe and enter substrate 10 as in FIG. 1, or substrate 11 as in FIG. 2. For ease of insertion into pipes 34, sleeve containers 40 are generally packed with particles or granules of the various one or more solid VCI compounds so that the generally cylindrical shape of the sleeves are maintained. That is, the sleeves are generally fully packed so that upon insertion into the various pipes, they do not deform and jam. The sleeve containers of course are closed at the ends thereof and can have strings, twine, wires, or other fasteners that would connect one sleeve container to an adjacent sleeve container or attached to a central lead. Thus, upon depletion of the solid VCI compound within the sleeves, the same can be readily removed from the pipe system by pulling on the string, leader or removed one by one by means of a snake or similar device. Refilled or new sleeve containers can then quickly be installed to replenish the pipe grid system. The packed sleeves can occupy a portion of the perforated system such as about at least 20%, 30%, or 40% of the total perforated pipe length, or substantially most of the pipe length such as at least about 60%, 70%, 80%, or 90%, or even 100%.

Generally any solid VCI compound known to the art and to the literature can be utilized that protect metal tank bottoms. Suitable solid VCIs for use in the present invention are disclosed in U.S. Pat. Nos. 4,290,912; 5,320,778; and 5,855,975, which are incorporated herein by reference in their entirety for their teachings of such compounds. Examples of VCIs set forth in U.S. Pat. No. 4,290,912 include inorganic nitrite salts including metal nitrites, preferably Group I and II metal nitrites such as potassium nitrite, sodium nitrite, barium nitrite, and calcium nitrite. Organic nitrite salts can also be used. Examples of solid VCIs set forth in U.S. Pat. Nos. 5,320,778 and 5,855,975 include anhydrous sodium molybdate [$Na_2MoO_4$], anhydrous ammonium dimolybdate [$(NH_4)_2Mo_2O_7$], or an anhydrous amine-molybdate. Desired amine molybdates include dicyclohexylamine, 2-ethylhexylamine, and cyclohexylamine. Another group of VCIs comprise amine benzoates, amine nitrates, and benzotriazole. Other VCIs comprise cyclohexylamine benzoate, ethylamine benzoate, and dicyclohexylamine nitrate. Useful volatile or vapor phase corrosion inhibitors also include but are not limited to, tolytriazole and salts thereof, and mixtures of benzoates of amine salts with benzotriazole, nitrates of amine salts, or $C_{13}H_{26}O_2N$. Preferred solid VCI compounds include sodium nitrite, amine salts, benzoates, nitrobenzoates, phosphates, carbonates, imidazolines, and the like. The various solid VCI compounds are generally in particle or granular form.

As noted above, sleeve containers 40 are made of a material that is permeable or breathable with respect to the vapors of the various solid VCI compounds. That is, the solid VCI compound sublimate from a solid to a vapor without appearing in the intermediate liquid state, achieving the inherent vapor pressure of each material. The vapors then permeate through the sleeve material and flow through perforated pipe 34 until it encounters perforation 36 whereby it is emitted or release from pipe 34. The vapors then permeate substrate 10 as in FIG. 1, or substrate 11 as in FIG. 2, and being a gas, generally rise until it encounters an obstruction such as soil side bottom surface 7 of tank 1. The various VCI vapor often form a thin protective film which limits the penetration of any corroding species to the metal surface, or the VCI may be absorbed in an electrolyte film which may have previously formed on the metal surface and will then inhibit corrosion according to the mechanisms of contact inhibitors.

In an alternative, desired embodiment of the present invention, mixtures or blends of VCI can be utilized with one or more SCI compounds so that in some cases, as when sand located under the tank bottom comes into contact with water, the SCI within the sleeve can dissolve therein and protect the tank bottom from corrosion by increasing the pH, decreasing corrosiveness of the environment, or by forming a passivating layer thereon. That is, while the VCI in the sleeve is initially dry, in some situations, as after a heavy rain, water may infiltrate the sleeve. Also, in some cases, the VCI and SCI can work in the same time in different areas of the tank bottom as in wet portions and dry portions of the substrate. In the use of such blends, the SCI compound generally contributes very little, if any, to corrosion protection of the tank bottom under dry conditions, but in wet situations as the occurrence of heavy rains or flooding, the SCI is dissolved and provides corrosion protection.

The amount of SCI utilized in the mixture or blend generally ranges from about 0 or 1% to about 50%, desirably from about 10% to about 30%, and preferably from about 15% to about 25% by weight based upon the total weight of all one or more SCI compounds and one or more VCI compounds. Suitable SCI compounds are known to the literature and to the art and include, but are not limited to, borates, carbonates, phosphates, polyphosphates, and silicates.

As noted, substrate 10 typically is sand and/or soil. Thus, as noted above, upon release of the VCI vapors into the substrate, they will rise and contact soil side surface 7 of the tank bottom and impart corrosion protection thereto.

As also noted above, when the substrate is hard, for example concrete, bitumen mixtures or asphalt, as shown in FIG. 5 channels 12 are formed within the substrate and along the length of perforated pipes 34. The channels have a liner 18 therein that is filled with clean sand 14, etc., so that the VCI vapor can penetrate there through and contact the bottom of storage tank 1. Although portions of the tank bottom will not contact channel fill 14, but rather a hard substrate such as concrete, due to natural and inherent breathing characteristics of storage tanks, and the inherent geometry of the construction of the tank bottom, e.g., overlapped plates welded together, voids are formed between tank bottom surface 7 and the top surface 15 of the hard substrate. That is, as known to those skilled in the art, the bottom of the storage tank has slight movements due to filling and entering operations, temperature variation, and the like. This inherent breathing aspect creates pathways, openings, and the like, that the VCI vapors penetrate and thus extend beyond channels 12 and protect tank soil side bottom 7.

The invention will be better understood by reference to the following examples that serve to illustrate, but not limit the present invention.

Accelerated testing was utilized to simulate the environment of the tank bottom not in direct contact with the underlying sand base (airspace). A small amount of contaminant solution was added to the bottom of a shallow plastic container. A layer of sand mixed with inhibitor was then added to the container. Slits were made into short sections of PE tubing to create "feet". The feet were added to each of the corners of steel panels. The panels were placed upon the sand, thereby creating an air gap between the panel surface and the sand. The plastic containers were sealed closed and aged at 50° C. for 10 days. During that time, the contaminant solution generated water vapor and $SO_2$ gas. At the end of the aging period, they were removed from the containers and the corrosion products removed. A summary of the protection efficiencies is as follows:

| VCI Mixture | Average Protection Efficiency (%) |
|---|---|
| A | 99 |
| B | 99 |
| C | 98 |
| D | 98 |
| E | 97 |
| F | 96 |
| G | 93 |
| H | 90 |
| I | 87 |
| J | 70 |
| K | 62 |

As apparent from the above data, the pipe system of the present invention results in good corrosion protection to soil side tank bottom surfaces.

A second accelerated test was utilized to simulate the environment of the tank bottom in direct contact with the underlying sand layer. One hundred milliliters of tap water or tap water with 0.5% inhibitor was added to the bottom of the test vessel (4×17×17 cm, H×W×L). Sand added to container to a depth of about ⅓ of container to completely cover water. Dry sand added almost to the top of the container. Two clean steel test panels are attached to a piece of rigid PE (polyethylene) with double sided tape. The panel assembly was placed with the steel panel face down on top of the sand bed. A sheet of 2 mil PE placed on top of container. A lid was added to container. A five pound weight was placed on top of the lid. Containers were aged in a circulating air oven at 40° C. Samples were checked for corrosion at various intervals. A summary of the testing is as follows:

| Tests | Corrosion on Panel Face Contacting Sand Oven Aging, Weeks at 40° C. | | | | | |
|---|---|---|---|---|---|---|
| Environments | 1 | 4 | 5 | 6 | 7 | 8 |
| Without Inhibitor | Yes | Yes | Yes | Yes | Yes | Yes, Yes, Yes |
| With Inhibitor | No | No | No | No | No | No, Yes, Yes |

As apparent from the above, good results were obtained inasmuch as there was no corrosion on the panel face contacting the sand, until after 8 weeks of aging.

While in accordance with the Patent Statutes, the best mode and preferred embodiments have been set forth, the scope of the invention is not limited thereto, but rather, by the scope of the attached claims.

What is claimed is:

1. A storage tank corrosion protection system, comprising:

a pipe system comprising one or more perforated pipes located beneath said storage tank;

at least one sleeve container having at least one solid volatile corrosion inhibitor (VCI) compound therein, said at least one sleeve capable of being located within at least a portion of said perforated pipes, said sleeve container being initially free of a liquid, and said perforated pipe being free of a blown in VCI powder;

optionally at least one solid SCI compound mixed with said solid VCI compound located in said sleeve container; and said sleeve being permeable to vapor emitted from said at least one solid VCI compound but not permeable to said solid VCI compound, said vapor capable of being emitted from said piping system through said perforations of said perforated pipe.

2. The storage tank corrosion protection system according to claim 1, wherein said perforated pipes are curvilinear or substantially straight.

3. The storage tank corrosion protection system according to claim 2, wherein said sleeve has an air permeability of from about 1 to about 1,000 cubic feet per minute per square foot, and wherein said sleeve container is located in said perforated pipe.

4. The storage tank corrosion protection system according to claim 3, wherein said pipe system contains a plurality of perforated pipes, and wherein a plurality of sleeves are contained in said perforated pipes; and wherein the diameter of said sleeve is from about 5% to about 95% of the diameter of said perforated pipe.

5. The storage tank corrosion protection system according to claim 4, wherein only said solid VCI compound is utilized; wherein said solid VCI compound comprises an inorganic nitrite salts, organic nitrite salts, anhydrous sodium molybdate, an anhydrous ammonia dimolybdate, or anhydrous amine molybdates, amine benzoate, amine nitrate, benzotriazole, cyclohexylamine benzoate, ethylamine benzoate, dicyclohexylamine nitrate, tolytriazole and salts thereof, or $C_{13}H_{26}O_2N$, and any combination thereof.

6. The storage tank corrosion protection system according to claim 4, wherein said pipes are made of plastic, wherein said perforated pipe is substantially straight, and wherein said sleeve air permeability is from about 100 to about 300 cubic feet per minute per square foot, wherein said sleeve diameter is from about 50% to about 90% of said perforated pipe diameter; wherein said sleeves can be connected to one another; and wherein said solid VCI compound comprises a sodium nitrite, an amine salt, a benzoate, a nitrobenzoate, a phosphate, a carbonate, an imidazoline, or any combination thereof.

7. The storage tank corrosion protection system according to claim 5, wherein said sleeves have less than about 5% by weight of a liquid therein based upon the total weight of said VCI therein, wherein said sleeve diameter is from about 70% to about 85% of said pipe diameter; and wherein said solid VCI compound comprises a sodium nitrite, an amine salt, a benzoate, a nitrobenzoate, a phosphate, a carbonate, an imidazoline, or any combination thereof.

8. The storage tank corrosion protection system according to claim 4, including said at least one SCI compounds, wherein the amount of said SCI compound ranges from about 1 to about 30 weight percent based upon total weight of all of said SCI compounds and said VCI compounds.

9. The storage tank corrosion protection system according to claim 8, wherein said solid SCI compound comprises a borate, a carbonate, a phosphate, a polyphosphate, a silicate, or any combination thereof.

10. The storage tank corrosion protection system according to claim 9, wherein said pipes are made of plastic, wherein said perforated pipe is substantially straight, and wherein said sleeve air permeability is from about 100 to about 300 cubic feet per minute per square foot, wherein said sleeve diameter is from about 50% to about 90% of said perforated pipe diameter; wherein said sleeves can be connected to one another; and wherein the amount of said solid SCI compound ranges from about 15% to about 35% based upon the total weight of all SCI compounds and said VCI compounds.

11. A process system for providing corrosion protection to a storage tank soilside bottom, comprising:

a pipe system comprising one or more perforated pipes located under said storage tank bottom having a tank substrate area there below;

one or more sleeve containers having at least one solid VCI compound therein, said sleeve being permeable to vapor emitted from said at least one solid VCI compound but not permeable to said solid VCI compound, said sleeve container being initially free of a liquid;

optionally at least one solid SCI compound mixed with said solid VCI compound located in said sleeve container;

inserting said one or more sleeve containers into said pipe system, said sleeve adapted to release said VCI vapor into said perforated pipe; and subsequently emitting said VCI vapor from said perforated pipe into said tank substrate area.

12. The process system of claim 11, wherein the diameter of said sleeve is from about 5% to about 95% of the diameter of said perforated pipe.

13. The process system of claim 12, including a plurality of said perforated pipes and a plurality of said sleeve containers.

14. The process system of claim 13, wherein only said solid VCI compound is utilized; wherein said solid VCI compounds comprise an inorganic nitrite salts, organic nitrite salts, anhydrous sodium molybdate, an anhydrous ammonia dimolybdate, or anhydrous amine molybdates, amine benzoate, amine nitrate, benzotriazole, cyclohexylamine benzoate, ethylamine benzoate, dicyclohexylamine nitrate, tolytriazole and salts thereof, or $C_{13}H_{26}O_2N$, and any combination thereof.

15. The process system of claim 14, wherein said sleeve diameter is from about 70% to about 95% of the diameter of said perforated pipe, and wherein said sleeve has an air permeability of from about 1 to about 1,000 cubic feet per minute per square foot.

16. The process system of claim 15, wherein said solid VCI compound comprises a sodium nitrite, an amine salt, a benzoate, a nitrobenzoate, a phosphate, a carbonate, an imidazoline, or any combination thereof.

17. The process system of claim 13, wherein said permeable pipes are uniformly distributed in said tank substrate area, and wherein said perforated pipe is free of a blown in VCI.

18. The process system of claim 17, including said SCI powder, wherein said SCI compound comprises a borate, a carbonate, a molybdate, a phosphate, a polyphosphate, silicate, or any combination thereof, and wherein the amount of said solid SCI compound ranges from about 1% to about 30% based upon the total weight of all SCI compounds and said VCI compounds.

19. The process system of claim 18, wherein the amount of said air blown in powder is less than about 10% by weight based upon the total weight of said VCI in said one or more sleeves, and wherein the amount of liquid within the one or more sleeves is about 3% by weight or less based upon the total weight of VCI in said one or more sleeve containers.

20. The process system of claim 19, wherein said sleeve diameter is from about 70% to about 95% of the diameter of said perforated pipe, wherein said sleeve has an air permeability of from about 1 to about 1,000 cubic feet per minute per square foot, and wherein the amount of said solid SCI compound ranges from about 15% to about 35% based upon the total weight of all SCI compounds and said VCI compounds.

* * * * *